US006848140B2

(12) United States Patent
Cho

(10) Patent No.: US 6,848,140 B2
(45) Date of Patent: Feb. 1, 2005

(54) WASHING MACHINE AND SYSTEM DATA CHANGING METHOD OF THE SAME

(75) Inventor: In Haeng Cho, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/685,793

(22) Filed: Oct. 16, 2003

(65) Prior Publication Data

US 2004/0079120 A1 Apr. 29, 2004

Related U.S. Application Data

(62) Division of application No. 09/944,378, filed on Sep. 4, 2001.

(30) Foreign Application Priority Data

| | | |
|---|---|---|
| Sep. 4, 2000 | (KR) | 2000-52108 |
| Sep. 6, 2000 | (KR) | 2000-52760 |
| Sep. 15, 2000 | (KR) | 2000-54246 |
| Sep. 19, 2000 | (KR) | 2000-54991 |

(51) Int. Cl.[7] ..... D06F 33/00; G06F 19/00

(52) U.S. Cl. ..... 8/159; 700/19; 700/86; 700/117

(58) Field of Search ..... 8/158–159; 68/12.01–12.02, 68/12.16, 12.23; 700/11, 19, 83, 86, 90, 117; 707/100–102

(56) References Cited

U.S. PATENT DOCUMENTS

| | | | | |
|---|---|---|---|---|
| 4,977,394 A | | 12/1990 | Manson et al. | 340/679 |
| 5,611,327 A | | 3/1997 | Teixeira Filho et al. | 126/39 R |
| 5,647,231 A | * | 7/1997 | Payne et al. | 68/12.01 |
| 5,799,281 A | * | 8/1998 | Login et al. | 705/1 |
| 5,960,804 A | * | 10/1999 | Cooper et al. | 134/56 D |
| 5,987,105 A | | 11/1999 | Jenkins et al. | 379/106.01 |
| 6,167,358 A | * | 12/2000 | Othmer et al. | 702/188 |
| 6,241,782 B1 | * | 6/2001 | Vande Haar | 8/159 |
| 6,425,156 B1 | * | 7/2002 | Knopp et al. | 8/159 |

FOREIGN PATENT DOCUMENTS

| | | |
|---|---|---|
| DE | 4422128 | 1/1996 |
| EP | 0715235 | 6/1996 |

* cited by examiner

*Primary Examiner*—Frankie L. Stinson
*Assistant Examiner*—Joseph L. Perrin
(74) *Attorney, Agent, or Firm*—Fleshner & Kim, LLP

(57) ABSTRACT

A washing machine and a method of changing system data therein that can grasp causes such as trouble of the product itself, problems on installation, problems on the regional characteristics, living pattern change of a user, etc., and change/replace a pre-stored program to/by a wash-related program that can solve the problems. The washing machine includes an outer tank, an inner tank, a load section, a microcomputer for controlling drive of the load section and reading an operation state of the load section, a key input section, a display section, an interface section for sending/receiving wash-related data to/from an external device, and a memory for enabling data read/write and storing the program or data received from the external device. If a data-change command is externally or internally produced, the wash-related program is changed through processes of data movement/copy/deletion for each sector in the memory by executing a program for data communication, and thus the convenience in use, washing performance, and operational efficiency can be maximized. Also, the trouble diagnosis and repair performed by the user or service man can be facilitated through the display of the changed program version.

27 Claims, 5 Drawing Sheets

WASHING MACHINE AND SYSTEM DATA CHANGING METHOD OF THE SAME

This application is a Divisional of application Ser. No. 09/944,378 filed Sep. 4, 2001.

BACKGROUND OF THE INVENTION

1. Field of the Invention

The present invention relates generally to a washing machine, and more particularly, to a washing machine and a method of changing system data therein that can achieve increase of convenience in use, improvement of washing performance, and improvement of operational efficiency by grasping causes such as trouble of the product itself, problems on installation, problems on the regional characteristics, living pattern change of a user, etc., and coping with such causes.

2. Background of the Related Art

Generally, a washing machine is a machine that removes pollutants from polluted laundry through processes of washing, rinsing, dehydration, etc. The washing machine is briefly classified into a full-automatic washing machine using rotation of a rotating wing, outer tank (i.e., washing tank), and inner tank (i.e., dehydrating tank) in a horizontal direction, and a drum washing machine using rotation of a drum in a vertical direction. To cope with diverse desires of users, diverse washing courses, functions, etc. have been developed and applied to actual products.

A conventional washing machine, as shown in FIG. 1, includes a motor 10 for directly or indirectly rotating a washing wing, inner tank, or outer tank, a load 11 such as a feed water pump, drain pump, etc., a key input section 12 for a user's input of various kinds of wash-related operation command, a display section 13 for displaying the operation state of the washing machine, functions, etc., and a system microcomputer 14 for controlling the driving of the motor 10 and the load 11 so that the washing operation corresponding to the user's operation command inputted through the key input section 12 is performed, and controlling the display section 13 so that the corresponding operation state or function is displayed.

At this time, the display section 13 is provided with light emitting diodes (LEDs), and the system microcomputer 14 is provided with a ROM for storing unchangeable wash-related programs.

The operation of the conventional washing machine as described above will now be explained.

First, the user turns on the power of the washing machine, throws laundry into the washing tank, and inputs a washing command through the key input section 12.

The system microcomputer 14 recognizes the washing command, reads out the corresponding washing program from the internal ROM, and performs the washing by driving the motor 10 and the load 11 based on the washing program.

At the same time, the system microcomputer 14 controls the display section 13 to display the present wash proceed state.

The conventional washing machine, however, may not fully perform its own function due to disharmony between the built-in programs and diverse use environments even though the product itself is not in trouble. This may cause the user to misunderstand its function as a trouble state, and also cause a service man not to able to grasp the cause of trouble of the product.

Now, the disharmony between the built-in program and the use environment is as follows.

The case that the product itself is not in trouble, but the user cannot be satisfied with the washing performance is mainly caused by the degree of hardness of water. That is, the washing performance is greatly affected by the degree of hardness of water (i.e., hard water/soft water), and in order to improve the washing performance, it is required to match the program to the use environment by changing programs of controlling a rotating angle of the washing wing, washing time, etc. However, the predetermined program of the conventional washing machine cannot be changed.

Also, the property of laundry is changed according to the change of family members. For example, the laundry of a newly married couple can be washed through a standard washing. If they have a baby, diapers are included in the laundry, and should be washed using a washing program having a strong rinsing function for sanitary reasons. According to the conventional washing machine, however, it is impossible to change the washing program.

Since the program change is impossible in the conventional washing machine, problems due to the above-described change of living patterns cannot be solved.

Next, even if a problem caused by the use environment, which is not a defect of the product itself, is misunderstood as a trouble, a service man may not find the cause of the problem, and thus make improper repairs.

During a dehydrating process, the washing tank may not rotate or rotate at a low speed, and thus the dehydration may not be performed. This may be caused by the trouble of the motor itself, or restricted rotation of the washing tank due to the tension of bubbles excessively produced due to an excessive input of a detergent. In this case, the motor may be damaged due to overload. However, the service man cannot find the cause of trouble, and thus it is difficult for the service man to consider a countermeasure.

Also, if the water-supply time is lengthened due to the problems on the water pressure of the house where the washing machine is installed, installation position (i.e., a high/low elevated area), water-supply method, etc., the user recognizes the trouble of water supply, and informs the trouble to a service center. In this case, the service man checks a water-supply valve, but if the water-supply valve is not in trouble, he cannot grasp the cause of the trouble.

In case that the service man can take in detail the use history, trouble history, etc. of the washing machine, he can analogize and analyze the trouble of the product and its components, or the use environment that is recognized as the trouble. However, according to the conventional washing machine, the operation state of the product, use history, trouble history, etc. cannot be grasped, and thus the service man cannot properly cope with the above-described causes.

In consequence, the conventional washing machine has the following problems.

First, since the operation state of the product, use history, and trouble history are be stored, the above-described causes cannot be grasped during the repair of the product, and thus any hardwired countermeasure such as replacement of a component cannot solve the problems.

Second, since the unchangeable washing program is stored in a low-capacity memory, the problems due to the installation state of the product, regional characteristics, change of the living patterns, etc. cannot be solved.

SUMMARY OF THE INVENTION

Accordingly, the present invention is directed to a washing machine and a method of changing system data therein that substantially obviates one or more problems due to limitations and disadvantages of the related art.

An object of the present invention is to provide a washing machine and a method of changing system data therein that can replace/change a pre-stored washing program by/to a proper washing program in accordance with the use environment of the washing machine, change of the family members, change of the living patterns, change of the season, etc.

Another object of the present invention is to provide a washing machine and a method of changing system data therein that can grasp the basic cause of the trouble by grasping the user history of respective components of the washing machine, and enable a perfect solution of the trouble.

Still another object of the present invention is to provide a washing machine and a method of changing system data therein that can obtain washing information on the development of an improved washing machine by grasping the user-preferred washing pattern, contents of wash, and cause of the trouble.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing machine includes an outer tank for storing washing water; an inner tank installed rotatably in the outer tank; a load section composed of a motor for driving the inner tank, a water supply means for supplying the washing water, and a draining means for draining the washing water; a microcomputer for controlling drive of the load section and reading an operation state of the load section; a key input section for a user's input of various kinds of operation commands and setting of functions of the washing machine; a display section for displaying the functions and operation state of the washing machine; an interface section for sending/receiving wash-related data such as wash or dehydration to/from an external device; and a memory for enabling data read/write and storing the program or data received from the external device.

In another aspect of the present invention, a washing machine includes an outer tank for storing washing water; an inner tank installed rotatably in the outer tank; a load section composed of a motor for driving the inner tank, a water supply means for supplying the washing water, and a draining means for draining the washing water; a microcomputer for controlling drive of the load section and reading an operation state of the load section; a key input section for a user's input of various kinds of operation commands and setting of functions of the washing machine; a display section for displaying the functions and operation state of the washing machine; and a memory for enabling data read/write and storing a use history of the load section.

In still another aspect of the present invention, there is provided a method of changing system data in a washing machine that includes a memory, divided into a predetermined number of sectors, for enabling data read/write, an interface section for exchanging data with an external device, and a microcomputer for controlling components of the washing machine so that a washing operation corresponding to an operation command of a user is performed, and storing data transmitted from the external device in the memory or changing the data stored in the memory, wherein programs for data communication with the external device or between the components of the washing machine are stored in at least one of the memory and the microcomputer, the method comprising the steps of: if a data-change command is externally or internally produced, executing the program for the data communication stored in the microcomputer or in a first sector of the memory; if the data to be changed is partial data of a second sector, the microcomputer copying all the data in the second sector into a third sector where no data is stored using the program for the data communication and deleting the data of the second sector; the microcomputer receiving a download of the data for change through the interface section using the program for the data communication and writing the data in the second sector; and the microcomputer copying the data that excludes the changed data among the data of the third sector into the second sector.

In still another aspect of the present invention, there is provided a method of changing system data in a washing machine that includes a memory, divided into a predetermined number of sectors, for enabling data read/write, an interface section for exchanging data with an external device, and a microcomputer for controlling components of the washing machine so that a washing operation corresponding to an operation command of a user is performed, and storing data transmitted from the external device in the memory or changing the data stored in the memory, wherein programs for data communication with the external device or between the components of the washing machine are stored in at least one of the memory and the microcomputer, the method comprising the steps of: if a data-change command is externally or internally produced, executing the program for the data communication stored in the microcomputer or in a first sector of the memory; if the data to be changed is partial data of a second sector, the microcomputer copying all the data in the second sector into a third sector where no data is stored using the program for the data communication and deleting the data of the second sector; the microcomputer receiving a download of the data for change through the interface section using the program for the data communication; judging whether the download has been normally performed and if it is judged that the download has been normally performed, writing the downloaded data in the second sector and copying the data that excludes the changed data among the data of the third sector into the second sector; and if it is judged that the download has not been normally performed, restoring the stored data of the third sector to the second sector.

In still another aspect of the present invention, there is provided a method of changing system data in a washing machine that includes a memory, divided into a predetermined number of sectors, for enabling data read/write, an interface section for exchanging data with an external device, and a microcomputer for controlling components of the washing machine so that a washing operation corresponding to an operation command of a user is performed, and storing data transmitted from the external device in the memory or changing the data stored in the memory, wherein programs for data communication with the external device or between the components of the washing machine are stored in at least one of the memory and the microcomputer, the method comprising the steps of: if a data-change command is externally or internally produced, executing the program for the data communication stored in the microcomputer or in a first sector of the memory; if the data to be changed is partial data of a second sector, the microcomputer copying all the data in the second sector into a third sector where no data is stored using the program for the data communication and deleting the data of the second sector; the microcomputer receiving a download of the data for change through the interface section using the program for the data communication; judging whether the download has been normally performed and if it is judged that the download has been normally performed, writing the downloaded data in the second sector and copying the data that excludes the changed data among the data of the third sector into the second sector; if it is judged that the download has not been normally performed, judging whether a user selects a re-execution of the download or restoration to the previous data; if it is judged that the user selects the re-execution of the download, re-executing the data download; and if it is judged that the user selects the restore to the previous data, restoring the stored data of the third sector to the second sector.

In still another aspect of the present invention, there is provided a method of changing system data in a washing machine that includes a memory, divided into a predetermined number of sectors, for enabling data read/write, an interface section for exchanging data with an external device, and a microcomputer for controlling components of the washing machine so that a washing operation corresponding to an operation command of a user is performed, and storing data transmitted from the external device in the memory or changing the data stored in the memory, wherein programs for data communication with the external device or between the components of the washing machine are stored in at least one of the memory and the microcomputer, the method comprising the steps of: if a data-change command is externally or internally produced, executing the program for the data communication stored in the microcomputer or in a first sector of the memory; if the data to be changed is partial data of a second sector, the microcomputer copying all the data in the second sector into a third sector where no data is stored using the program for the data communication and deleting the data of the second sector; the microcomputer receiving a download of the data for change through the interface section using the program for the data communication; judging whether the download has been normally performed and if it is judged that the download has been normally performed, writing the downloaded data in the second sector and copying the data that excludes the changed data among the data of the third sector into the second sector; if it is judged that the download has not been normally performed, judging whether a user selects a re-execution of the download or restoration to the previous data; if it is judged that the user selects the re-execution of the download, re-executing the data download; if it is judged that the user selects the restore to the previous data, restoring the stored data of the third sector to the second sector; and displaying a version of the program changed through the download.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will now be made in detail to the washing machine and method of changing system data therein according to preferred embodiments of the present invention, examples of which are illustrated in the accompanying drawings.

Figure 1:
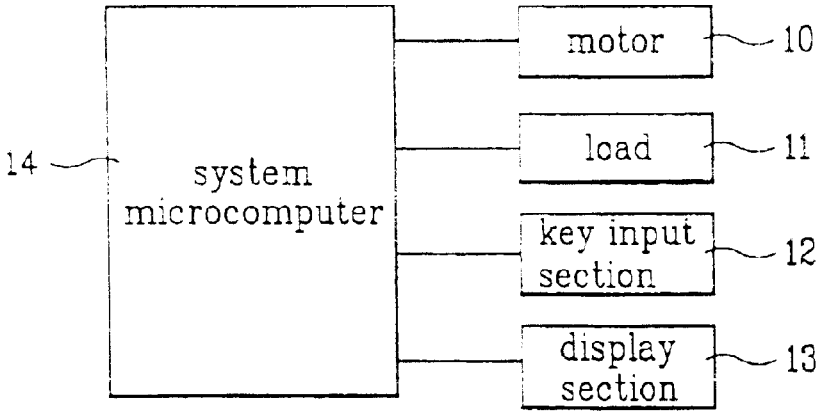
FIG.1 Background Art
FIG. 1 is a block diagram illustrating the construction of a conventional washing machine.
Figure 2:
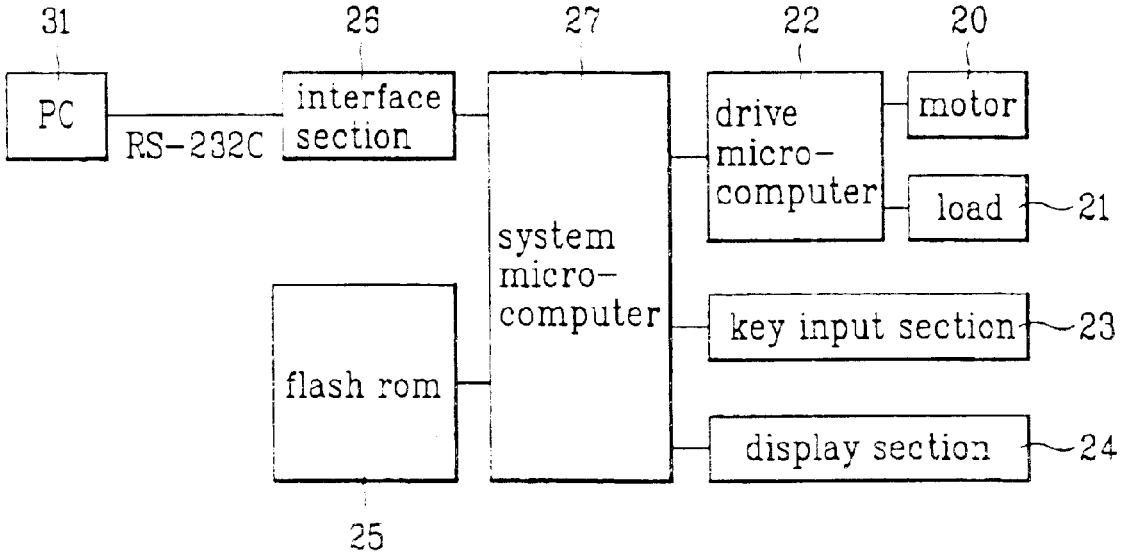
FIG. 2 is a block diagram illustrating the construction of a washing machine according to the present invention.

The washing machine according to the present invention, as shown in FIG. 2, includes a motor 20 for driving an inner tank, outer tank or washing wing, a load 21 composed of a water-supply valve, drain valve, etc., a drive microcomputer for controlling drive of the motor 20 and the load 21 and reading an operation state thereof, a key input section 23 for a user's input of various kinds of operation commands and setting of functions of the washing machine, a display section 24 for displaying the functions and operation state of the washing machine, a flash memory, i.e., flash ROM 25, for storing an operation algorithm of the washing machine and related information of the washing machine including a use history of the washing machine, an interface section 26 for performing a data modulation so as to enable data exchange with an external device connected according to the RS-232C communication standard such as a personal computer (PC) 31, and a system microcomputer 27 for controlling the drive microcomputer 22 so that the washing operation corresponding to the user's operation command inputted through the key input section 23 is performed, controlling the display section 24 so that the corresponding operation state or function is displayed, and storing in the flash ROM 25 the related information of the washing machine transmitted through the drive microcomputer 22 or data transmitted from the PC 31 through the interface section 26 or uploading information stored in the flash ROM 25 to the PC 31. The washing machine may further include a modem, directly connected to Internet, for enabling data exchange.

At this time, the flash ROM 25 is divided into 10 sectors having storage capacity of 8K to 64K bits. In the first sector are stored programs for data communication, i.e., a communication program for downloading/uploading through the PC 31 that is the external device and program for internal data communication such as data read/write/copy/deletion. Also, at least one sector is empty, and other sectors stores programs related to washing course, use history, and control.

The system microcomputer 27 may also store the program for data communication.

The operation of the washing machine as constructed above will now be explained.

First, the user turns on the power of the washing machine, throws laundry into the washing tank, and inputs a washing command through the key input section 23.

The system microcomputer 27 recognizes the washing command, reads out the corresponding washing program from the flash ROM 25, and transmits a driving signal for driving the motor 20 and the load 21 to the drive microcomputer 22 based on the read washing program.

Accordingly, the drive microcomputer 22 drives the motor 20 and the load 21 according to the driving signal transmitted from the system microcomputer 27 to perform the washing.

The system microcomputer 27 controls the display section 24 to display the present washing proceed state.

Also, the drive microcomputer 22 transmits the use history of the motor 20 and load 21 to the system microcomputer 27.

That is, data such as a rise in temperature and speed of the motor 20, water feed time, drain time, etc. is stored in the flash ROM 25 through the system microcomputer 27.

Then, the system microcomputer 27 stores in the flash ROM 25 the wash-related data selected by the user or the data of the process re-executed by the user who does not satisfy the result of the present washing process by executing the program for data communication stored in the system microcomputer 27 itself or the flash ROM 25.

Also, the system microcomputer 27 reads the data stored in the flash ROM 25 at predetermined intervals or when the trouble is produced, and directly uploads the data to the PC 31 connected through the interface section 26.

Accordingly, the service man can repair the product by monitoring the uploaded data through the PC 31 and grasping the cause of the trouble of the product using the related program pre-stored in the PC 31, or direct the corresponding user to a proper washing course and so on. The data uploaded from the washing machine can be used as information required for a future production.

Also, according to the present invention, the high-capacity flash ROM 25 enables the change of the program. That is, a wash-related program suitable for the user can be downloaded based on the data uploaded from the corresponding user, or the predetermined program can be changed.

For example, if a newly married couple has a baby and the laundry includes diapers and so on, the existing washing process cannot perform a sanitary washing of a level that the user requires. Thus, it is preferable to change the program or system data so that the rinsing process of the existing washing program is strengthened through a software provided from the manufacturer or a service man, or to newly add a sanitation-oriented washing program for washing the diapers.

At this time, the downloading and change of the program or system data is performed in a manner that the service man or the user directly connects his PC to the washing machine through the interface section 26, and downloads a specified program from the data of the PC itself or through the Internet, or changes the pre-stored program. Now, the program or system data changing operation will be explained in detail with reference to FIG. 3.

At this time, it is assumed that the sector to be changed is the second sector and the empty sector is the third sector among the sectors of the flash ROM 25.

Figure 3:
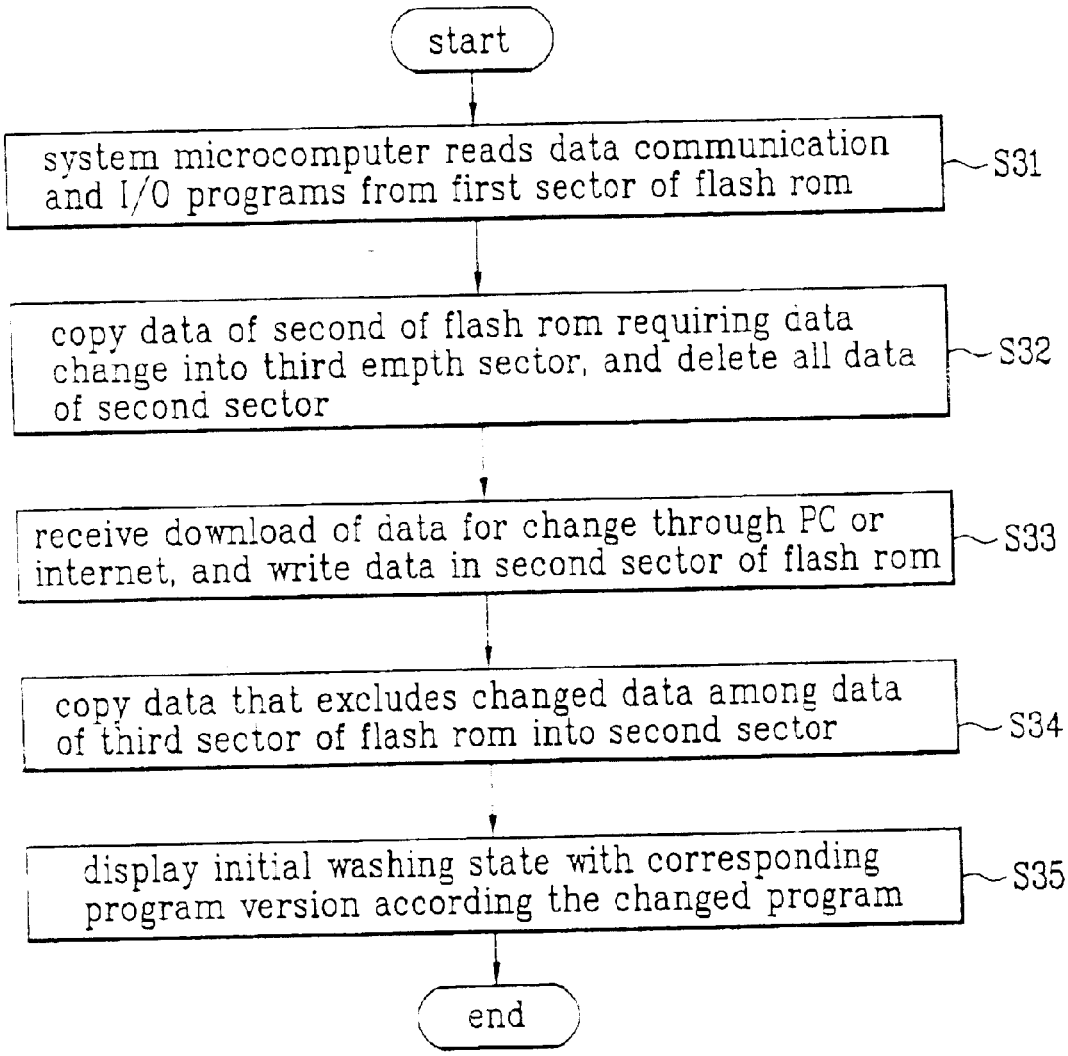
FIG. 3 is a flowchart illustrating a system data changing method in a washing machine according to the present invention.

As shown in FIG. 3, if the PC informs the data downloading to the system microcomputer 27, the system microcomputer 27 reads the data communication program for communicating with the external device that is stored in the first sector of the flash ROM 25 and the data input/output program for communicating with the internal components (step S31) to execute the program.

At this time, the data communication program and data input/output program may be pre-stored in the system microcomputer 27 instead of reading them from the first sector.

First, in case of changing only a portion of the second sector, the system microcomputer 27 copies the whole data of the second sector to the third sector, and then deletes all the data of the second sector (step S32).

The system microcomputer 27 then downloads the data for change through the PC or Internet using the data communication program, and writes the data in the second sector (S33).

Then, the system microcomputer 27 copies the data that excludes the changed data among the data of the third sector to the second sector (step S34) to complete the data change of the second sector.

Thereafter, the system microcomputer 27 displays a picture for an initial state of the washing machine according to the program of the memory in which the data change has been completed (step S35), and performs the washing operation corresponding to the operation command inputted thereafter by the user. At this time, the version of the changed program may also be displayed with the initial state of the washing machine. The purpose of displaying the version is as follows.

If any component of the washing machine such as the water-feed valve, motor, etc. is in trouble when the user changes and uses the data or program that matches the washing environment desired by the user, the user may call the service man in charge. The service man in charge operates the washing machine, and diagnoses the cause of trouble. At this time, since the service man does not know the changed portion of the data or program, it becomes difficult to diagnose and repair the product in trouble. Accordingly, through the display of the version of the changed program along with the initial state of the washing machine after the completion of the change of the data or program, the user or service man in charge can grasp the contents of the change, and easily diagnose and repair the product in trouble. The program version may also be displayed along with other washing proceed states in addition to the initial state of the washing machine, according to a predetermined condition, or according to a specified key signal inputted by the user or service man. Specifically, a key for confirming the version may be provided in a key panel of the washing machine, and if the key is pressed, the program version is displayed on the display screen. The program version may also be displayed by pressing at least two existing keys such as the rinsing key, washing key, etc. together.

Meanwhile, the data of the third sector is deleted before the data downloading.

Next, in case of changing the whole data of the second sector, the procedure is the same as the case that a portion of the data is changed except that the process of copying the data excluding the changed data is omitted.

Specifically, the whole data of the second sector is copied into the third sector, and the whole data of the second sector is deleted. At this time, the data of the second sector may be deleted in a state that the data of the second sector is not copied into the third sector.

Thereafter, the system microcomputer 27 downloads the data for change through the PC or Internet using the program for data communication, and writes the downloaded data in the second sector to complete the data change.

If the data change is completed as described above, the initial state of the washing machine, which includes or does not include the corresponding program version, is displayed, and then the washing operation is performed according to the operation command inputted by the user.

Meanwhile, the data downloading may be not performed accurately due to various causes such as an abnormal power supply, connection trouble, etc. during the data downloading. In order to solve this problem, the method of changing and processing data according to the first to third embodiments of the present invention will now be explained with reference to FIGS. 4 to 6.

First Embodiment

Figure 4:
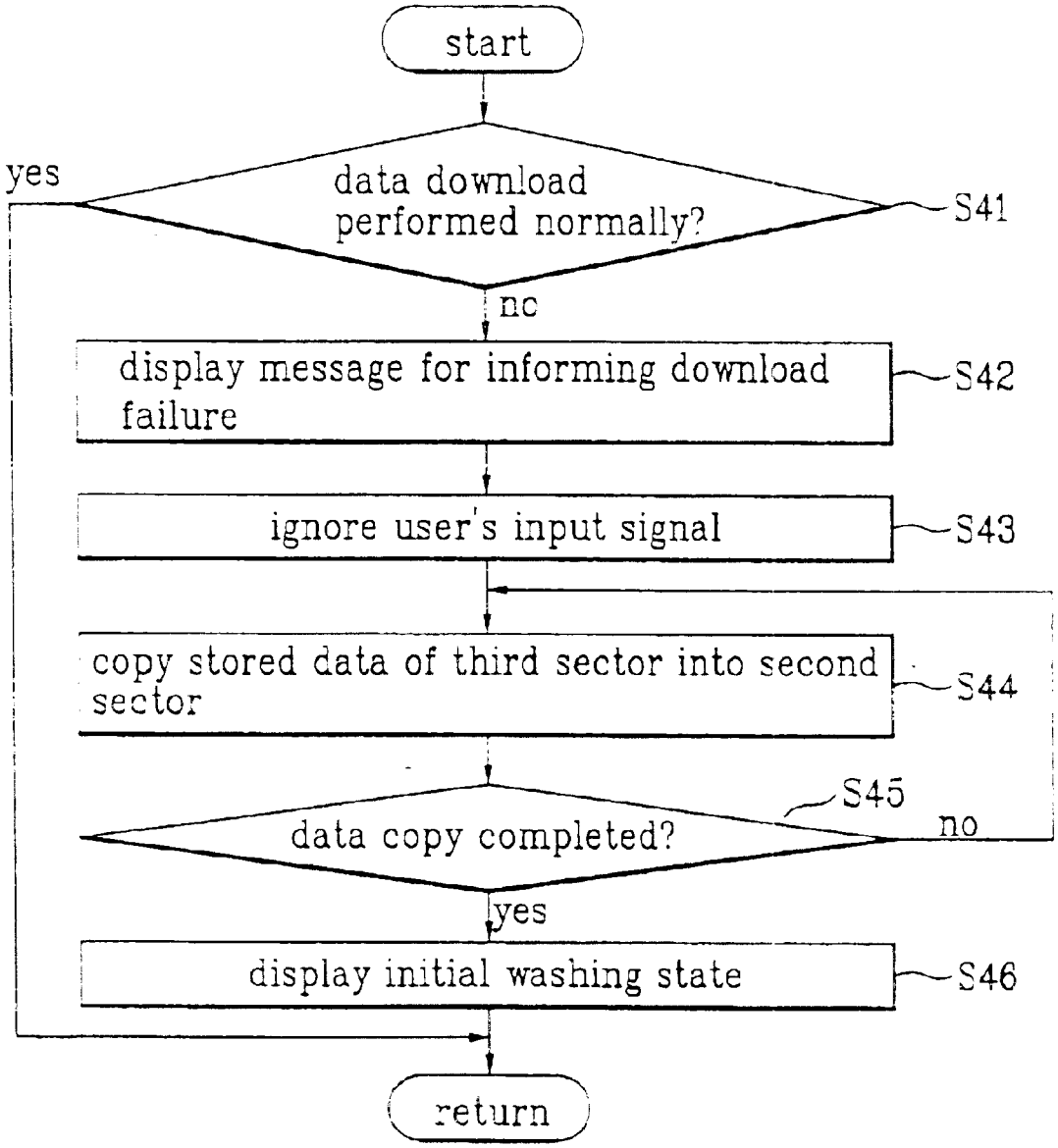
FIG. 4 is a flowchart illustrating a system data changing method when a download fails according to a first embodiment of the present invention.

As shown in FIG. 4, the system microcomputer 27 judges whether the data download has been normally performed (step S41). That is, the system microcomputer 27 judges whether the download is in trouble by checking the respective programs and downloaded data.

If the data download is in trouble as a result judgement (step S41), a message for informing a download failure such as "Data download has failed." is displayed through the display section 24 of the washing machine (step S42).

Then, the user's key signal input is ignored for the following data restoring work (step S43).

Thereafter, the original data copied into the third sector is copied again into the second section (step S44). Then, it is judged whether the data copy is completed (step S45), and if completed, the initial washing state is displayed according to the washing machine program restored into the second sector, i.e., according to the original washing machine program (step S46). At this time, the version of the corresponding program may also be displayed.

Thereafter, the following user's operation command is received, and the washing operation is performed accordingly.

Second Embodiment

Figure 5:
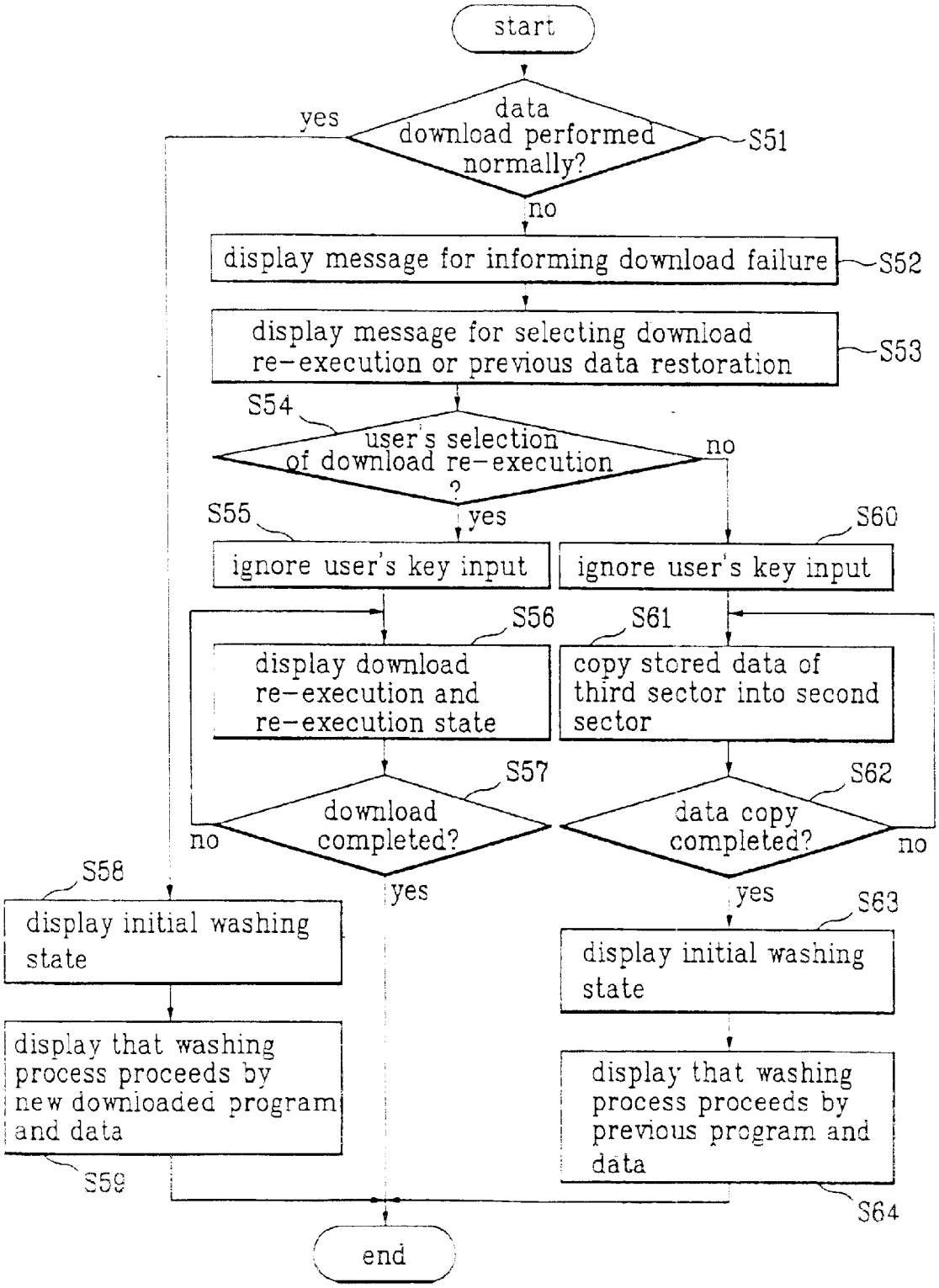
FIG. 5 is a flowchart illustrating a system data changing method when a download fails according to a second embodiment of the present invention.

As shown in FIG. 5, the system microcomputer 27 judges whether the data download has been normally performed (step S51). That is, the system microcomputer 27 judges whether the download is in trouble by checking the respective programs and downloaded data in the memory.

If the data download is in trouble as a result judgement (step S51), a message for informing a download failure such as "Data download has failed." is displayed through the display section 24 of the washing machine (step S52).

Then, a message such as "Select a download re-execution or a previous data restoration." so that the user can select one of the download re-execution and the previous data restoration (step S53).

Thereafter, it is judged whether the user selects the download re-execution (step S54). If it is judged that the user selects the download re-execution, the following user's key signal input is ignored (step S55), the download is re-executed by the method as shown in FIG. 3, and then a message for informing the download re-execution such as "Download is now being re-executed." is displayed (step S56).

Thereafter, it is judged whether the download has been completed (step S57), and if it is judged that the download has been completed, the procedure returns to the initial step (step S51), and it is judged again whether the data download has been normally performed. If it is judged that the download has been normally performed, the initial washing state is displayed (step S58), and a message such as "The washing process will proceed according to a new downloaded program." is displayed (step S59). Then, the washing process is performed according to the user's key input. At this time, the corresponding program version may also be displayed according to the above-described condition.

Meanwhile, if it is judged that the user does not select the download re-execution, i.e., if the user selects the data restoration, as a result of judgement (step S54), the following user's key input is ignored (step S60), and the original data copied into the third sector is copied again into the second sector (step S61).

Thereafter, it is judged whether the data copy has been completed (step S62), and if completed, the initial washing state is displayed (step S63). At this time, the corresponding program version may also be displayed according to the above-described condition.

Thereafter, a message for informing the user that the washing process will proceed according to the original program and data before the download such as "The washing process will proceed according to the original program." is displayed (step S64). Then, the washing operation is performed according to the user's key input.

Third Embodiment

Figure 6:
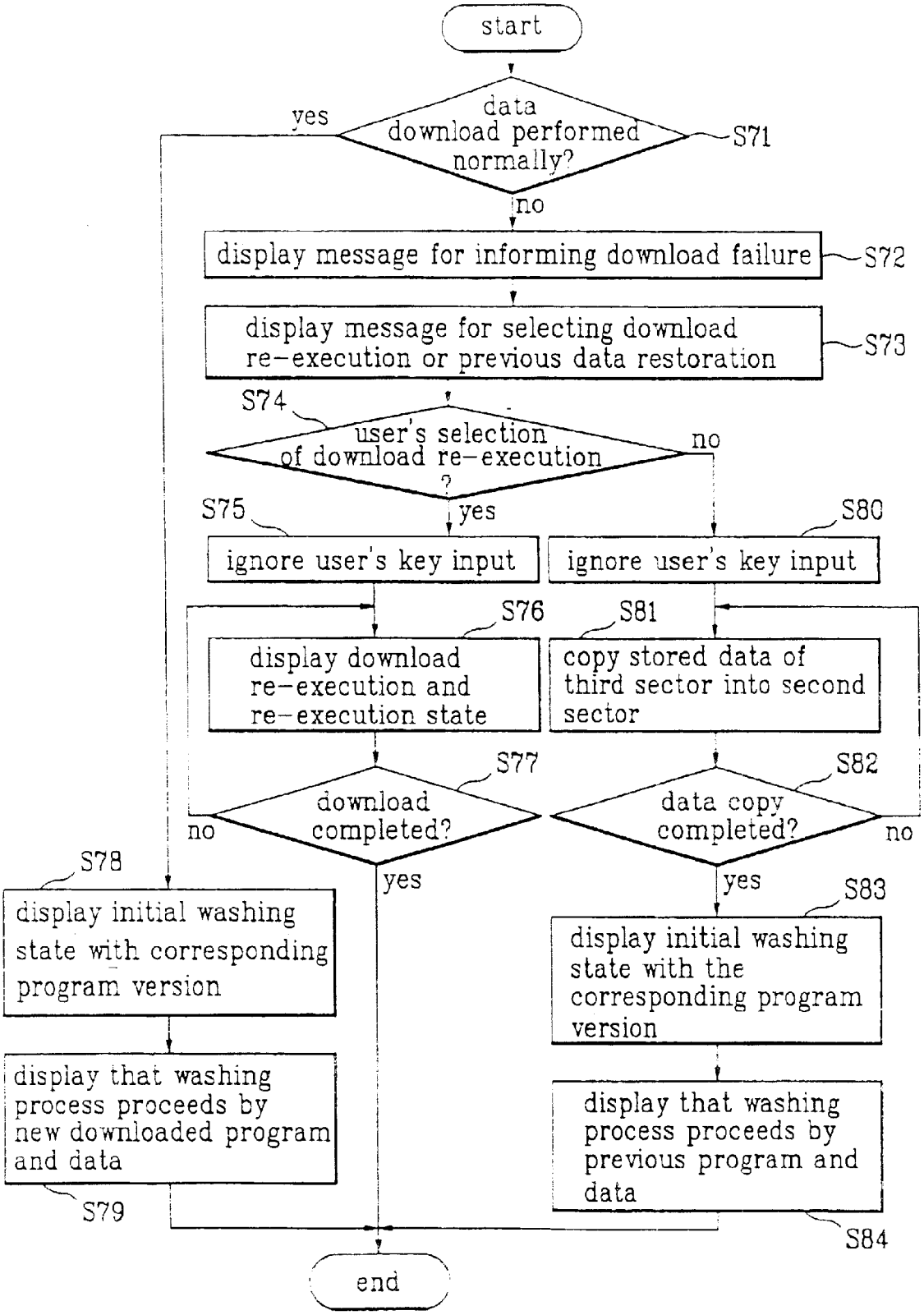
FIG. 6 is a flowchart illustrating a system data changing method when a download fails according to a third embodiment of the present invention.

As shown in FIG. 6, the system microcomputer 27 judges whether the data download has been normally performed (step S71). That is, the system microcomputer 27 judges whether the download is in trouble by checking the respective programs and downloaded data in the memory.

If the data download is in trouble as a result judgement (step S71), a message for informing a download failure such as "Data download has failed." is displayed through the display section 24 of the washing machine (step S72).

Then, a message such as "Select a download re-execution or a previous data restoration." so that the user can select one of the download re-execution and the previous data restoration (step S73).

Thereafter, it is judged whether the user selects the download re-execution (step S74). If it is judged that the user selects the download re-execution, the following user's key signal input is ignored (step S75), the download is re-executed by the method as shown in FIG. 3, and then a message for informing the download re-execution such as "Download is now being re-executed." is displayed (step S76).

Thereafter, it is judged whether the download has been completed (step S77), and if it is judged that the download has been completed, the procedure returns to the initial step (step S71), and it is judged again whether the data download has been normally performed. If it is judged that the download has been normally performed, the data change is performed by inserting the downloaded data in the corresponding memory, and then the initial washing state that includes the changed program version is displayed (step S78). Then, a message such as "The washing process will proceed according to a new downloaded program." is displayed (step S79), and the washing process is performed according to the user's key input.

Meanwhile, if it is judged that the user does not select the download re-execution, i.e., if the user selects the data restoration, as a result of judgement (step S74), the following user's key input is ignored (step S80), and the original data copied into the third sector is copied again into the second sector (step S81).

Thereafter, it is judged whether the data copy has been completed (step S82), and if completed, the initial washing state that includes the present program version is displayed (step S83).

Thereafter, a message for informing the user that the washing process will proceed according to the original program and data before the download such as "The washing process will proceed according to the original program." is displayed (step S84). Then, the washing operation is performed according to the user's key input.

As described above, the system data changing method in a washing machine according to the present invention can optimize the washing program to the user by storing and uploading to the PC connected to the washing machine the data such as the use history, trouble history, etc., of the product and changing or replacing the predetermined program. Thus, it can cope with troubles due to the external environment as well as troubles of the product itself, and thus maximize the convenience in use, washing performance, and operational efficiency. Also, it facilitates the trouble diagnosis and repair performed by the user or service man by displaying the changed program version.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A method of changing system data in a washing machine that includes a memory, divided into a predetermined number of sectors, for enabling data read/write, an interface section for exchanging data with an external device, and a microcomputer for controlling components of the washing machine so that a washing operation corresponding to an operation command of a user is performed, and storing data transmitted from the external device in the memory or changing the data stored in the memory, wherein programs for data communication with the external device or between the components of the washing machine are scored in at least one of the memory and the microcomputer, the method comprising the steps of:

if a data-change command is externally or internally produced, executing the program for the data communication stored in the microcomputer or in a first sector of the memory;

if the data to be changed is partial data of a second sector, the microcomputer copying all the data in the second sector into a third sector where no data is stored using the program for the data communication and deleting the data of the second sector;

the microcomputer receiving a download of the data for change through the interface section using the program for the data communication and writing the data in the second sector; and the microcomputer copying the data that excludes the changed data among the data of the third sector into the second sector.

2. The method according to claim 1, wherein the data of the third sector is deleted during a data download performed after the data that excludes the changed data among the data of the third sector is copied into the second sector.

3. The method according to claim 1, further comprising the steps of:

if the data to be changed is the whole data of the second sector, the microcomputer copying all the data of the second sector into the third sector where no data is stored using the data communication and input/output-related programs, and deleting the data of the second sector; and the microcomputer receiving the download of the data for change through the interface section using the data communication and input/output-related programs, and writing the downloaded data in the second sector.

4. The method as claimed in claim 1, further comprising the steps of:

if the data to be changed is the whole data of the second sector, the microcomputer deleting the data of the second sector using the data communication and input/output-related programs; and the microcomputer receiving the download of the data for change through the interface section using the data communication and input/output-related programs, and writing the downloaded data in the second sector.

5. A method of changing system data in a washing machine that includes a memory, divided into a predetermined number of sectors, for enabling data read/write, an interface section for exchanging data with an external device, and a microcomputer for controlling components of the washing machine so that a washing operation corresponding to an operation command of a user is performed, and storing data transmitted from the external device in the memory or changing the data stored in the memory, wherein programs for data communication with the external device or between the components of the washing machine are stored in at least one of the memory and the microcomputer, the method comprising the steps of:

if a data-change command is externally or internally produced, executing the program for the data communication stored in the microcomputer or in a first sector of the memory;

if the data to be changed is partial data of a second sector, the microcomputer copying all the data in the second sector into a third sector where no data is stored using the program for the data communication and deleting the data of the second sector;

the microcomputer receiving a download of the data for change through the interface section using the program for the data communication;

judging whether the download has been normally performed and if it is judged that the download has been normally performed, writing the downloaded data in the second sector and copying the data that excludes the changed data among the data of the third sector into the second sector; and if it is judged that the download has not been normally performed, restoring the stored data of the third sector into the second sector.

6. The method as claimed in claim 5, further comprising the step of if it is judged that the download has not been normally performed, displaying a message for informing a download failure through the display section.

7. The method as claimed in claim 5, further comprising the step of it is judged that the download has not been normally performed, ignoring a user's key input, during the step of restoring the stored data of the third sector into the second sector.

8. The method according to claim 5, wherein the data of the third sector is deleted during a data download performed after the data that excludes the changed data among the data of the third sector is copied into the second sector.

9. The method according to claim 5, further comprising the steps of:

if the data to be changed is the whole data of the second sector, the microcomputer copying all the data of the second sector into the third sector where no data is stored using the program for the data communication, and deleting the data of the second sector; and the microcomputer receiving the download of the data for change through the interface section using the program for the data communication, and writing the downloaded data in the second sector.

10. A method of changing system data in a washing machine that includes a memory, divided into a predetermined number of sectors, for enabling data read/write, an interface section for exchanging data with an external device, and a microcomputer for controlling components of the washing machine so that a washing operation corresponding to an operation command of a user is performed, and storing data transmitted from the external device in the memory or changing the data stored in the memory, wherein programs for data communication with the external device or between the components of the washing machine are stored in at least one of the memory and the microcomputer, the method comprising the steps of:

if a data-change command is externally or internally produced, executing the program for the data communication stored in the microcomputer or in a first sector of the memory;

if the data to be changed is partial data of a second sector, the microcomputer copying all the data in the second sector into a third sector where no data is stored using the program for the data communication and deleting the data of the second sector;

the microcomputer receiving a download of the data for change through the interface section using the program for the data communication;

judging whether the download has been normally performed and if it is judged that the download has been normally performed, writing the download data in the second sector and copying the data that excludes the changed data among the data of the third sector into the second sector;

if it is judged that the download has not been normally performed, judging whether a user selects re-execution of the download or restore to the previous data;

if it is judged that the user selects the re-execution of the download, re-executing the data download; and if it is judged that the user selects the restore to the previous data, restoring the storage data of the third sector to the second sector.

11. The method according to claim 10, further comprising the steps of:

if the data to be changed is the whole data of the second sector, the microcomputer copying all the data of the second sector into the third sector where no date is stored using the program for the data communication, and deleting the data of the second sector; and the microcomputer receiving the download of the data for change through the interface section using the program for the data communication, and writing the downloaded data in the second sector.

12. The method according to claim 10, further comprising the step of if the download has not been normally performed, displaying a message for informing a download failure, and then displaying a message for selecting a download re-execution or a data restoration.

13. The method according to claim 10, further comprising the step of if the user selects a download re-execution or a data restoration, ignoring the user's key input during performing a corresponding work.

14. The method according to claim 10, further comprising the step of if the user selects a download re-execution or a data restoration, displaying a state of a corresponding work.

15. The method according to claim 10, further comprising the step of if the data restoration is completed, displaying that the washing process is performed by the previous program.

16. The method according to claim 10, wherein the data of the third sector is deleted during a data download performed after the data that excludes the changed data among the data of the third sector is copied into the second sector.

17. A method of changing system data in a washing machine that includes a memory, divided into a predetermined number of sectors, for enabling data read/write, an interface section for exchanging data with an external device, and a microcomputer for controlling components of the washing machine so that a washing operation corresponding to an operation command of a user is performed, and storing data transmitted from the external device in the memory or changing the data stored in the memory, wherein programs for data communication with the external device or between the components of the washing machine are stored in at least one of the memory and the microcomputer, the method comprising the steps of:

if a data-change command is externally or internally produced, executing the program for the data communication stored in the microcomputer or in a first sector of the memory;

if the data to be changed is partial data of a second sector, the microcomputer copying all the data in the second sector into a third sector where no data is stored using the program for the data communication and deleting the data of the second sector;

the microcomputer receiving a download of the data for change through the interface section using the program for the data communication;

if it is judged that the download has been normally performed, writing the downloaded data in the second sector and copying the data that excludes the changed data among the data of the third sector into the second sector;

if it is judged that the download has not been normally performed, judging whether a user selects a re-execution of the download or a restoration to the previous data;

if it is judged that the user selects the re-execution of the download, re-executing the data download;

if it is judged that the user selects the restoration to the previous data, restoring the storage data of the third sector into the second sector; and displaying a version of the program changed through the download.

18. The method according to claim 17, further comprising the steps of:

if the data to be changed is the whole data of the second sector, the microcomputer copying all the data of the second sector into the third sector where no data is stored using the program for the data communication, and deleting the data of the second sector; and the microcomputer receiving the download of the data for change through the interface section using the program for the data communication, and writing the downloaded data in the second sector.

19. The method according to claim 17, further comprising the step of if the download has not been normally performed, displaying a message for informing a download failure, and then displaying a message for selecting a download re-execution or a data restoration.

20. The method according to claim 17, further comprising the step of it the user selects a download re-execution or a data restoration, ignoring the user's key input during performing a corresponding work.

21. The method according to claim 17, further comprising the step of if the user selects a download re-execution or a data restoration, displaying a state of a corresponding work.

22. The method according to claim 17, further comprising the step of if the data restoration is completed, displaying that the washing process is performed by the previous program.

23. The method according to claim 17, wherein the data of the third sector is deleted during a data download performed after the data that excludes the changed data among the data of the third sector is copied into the second sector.

24. The method according to claim 17, wherein the step of displaying the version of the program changed through the download is a step of display the version of the corresponding program throughout the display of an initial washing state is displayed after the change of the program.

25. The method according to claim 17, wherein the step of displaying the version of the program changed through the download is a step of displaying the version of the corresponding program throughout the display of all washing states after the change of the program.

26. The method according to claim 17, wherein the step of displaying the version of the program changed through the download is a step of displaying the version of the corresponding program when the user inputs a specified key.

27. The method according to claim 26, wherein the specified key is a version confirmation key or combination of at least one function key.

* * * * *